United States Patent [19]

Pfingston

[11] 4,401,746

[45] Aug. 30, 1983

[54] STRIPPING LAYER CONSISTING OF A MIXTURE OF CELLULOSE ACETATE HYDROGEN PHTHALATE AND STRAIGHT CHAIN SATURATED POLYESTER OF ADIPIC ACID

[75] Inventor: William J. Pfingston, Canton, Mass.

[73] Assignee: Polaroid Corporation, Cambridge, Mass.

[21] Appl. No.: 381,437

[22] Filed: May 24, 1982

[51] Int. Cl.[3] ..... G03C 1/40; G03C 1/90

[52] U.S. Cl. ..... 430/215; 430/236; 430/262

[58] Field of Search ..... 430/215, 262, 236

[56] References Cited

U.S. PATENT DOCUMENTS

| | | | |
|---|---|---|---|
| 2,759,825 | 8/1956 | Land | 430/262 |
| 2,983,606 | 5/1961 | Rogers | 430/215 |
| 3,227,550 | 1/1966 | Whitmore et al. | 430/226 |
| 3,658,524 | 4/1972 | Piesach | 430/207 |
| 4,009,031 | 2/1977 | Carlson et al. | 430/213 |
| 4,359,518 | 11/1982 | Hanselman et al. | 430/215 |

*Primary Examiner*—Richard L. Schilling
*Attorney, Agent, or Firm*—Sybil A. Campbell

[57] ABSTRACT

This invention relates to diffusion transfer photographic processes and to products useful therein which employ a stripping layer consisting of a mixture of cellulose acetate hydrogen phthalate and a straight chain saturated polyester of adipic acid to facilitate separation of a dyeable stratum from a contiguous gelatin layer, e.g., a gelatino silver halide emulsion layer or a gelatin layer containing an image dye-providing material.

11 Claims, 3 Drawing Figures

STRIPPING LAYER CONSISTING OF A MIXTURE OF CELLULOSE ACETATE HYDROGEN PHTHALATE AND STRAIGHT CHAIN SATURATED POLYESTER OF ADIPIC ACID

FIELD OF THE INVENTION

This invention relates to photography, and more particularly, it relates to improved photographic products useful in diffusion transfer processes and to diffusion transfer processes employing the same.

BACKGROUND OF THE INVENTION

The use of stripping layers in various photographic products is well known. Such layers have been employed, for example, in stripping films for transferring an image-bearing layer or layers from one support to another and in diffusion transfer photographic processes to facilitate separation of the image-receiving layer carrying the final transfer image from the photosensitive layer(s). Materials previously disclosed as useful for stripping layers include gum arabic; cellulose derivatives, e.g., hydroxyethyl cellulose, carboxymethyl cellulose, ethyl cellulose and cellulose acetate hydrogen phthalate; polyethylene glycol; sodium alginate; polyvinyl alcohol; polyvinyl pyrrolidone; polymethacrylic acid; and ethylene/maleic anhydride-acid copolymers.

A number of diffusion transfer processes for forming images in both silver and in dye have been disclosed in the art and need not be described in detail. In processes of this type, an exposed silver halide layer is treated with a processing composition whereby the exposed silver halide is developed and an imagewise distribution of diffusible image-forming components is formed in the unexposed and undeveloped portions of the silver halide layer. This distribution of image-forming components is transferred by imbibition to an image-receiving layer in superposed relationship with the silver halide layer to provide the desired transfer image. In color diffusion transfer processes, image formation relies upon a differential in mobility or solubility of image dye-providing material obtained as a function of development so as to provide an imagewise distribution of such material which is more diffusible and which, therefore, may be selectively transferred to an image-receiving layer comprising a dyeable stratum. This differential in mobility or solubility may be obtained, for example, by a chemical action such as a redox reaction, a siliver ion-assisted cleavage reaction or a coupling reaction.

In any of these color systems, multicolor images may be obtained by employing a photosensitive element containing at least two selectively sensitized silver halide layers each having associated therewith an image dye-providing material exhibiting the desired spectral absorption characteristics. The most commonly employed elements of this type are the so-called tripack structures employing a blue-, a green- and a red-sensitive siliver halide layer having associated therewith, respectively, a yellow, a magenta and a cyan image dye-providing material.

The photosensitive element and the image-receiving element may be separate components which are brought together during processing, or they may together comprise a unitary structure, e.g., an integral negative-positive film structure wherein the photosensitive element and image-receiving element are laminated and/or otherwise physically retained together at least prior to image formation. The resulting image may be revealed by separation of the image-receiving element from the photosensitive element subsequent to processing, although processes employing integral negative-positive film units are now well known in the art wherein the image-receiving component containing the dye transfer image need not be separated from the photosensitive element for viewing purposes.

The prior art contains several references to diffusion transfer film units which include a stripping layer to facilitate removal of the image-receiving component from the remainder of the film unit. U.S. Pat. No. 2,759,825 discloses the use of stripping layers comprising a hydrophilic colloid, e.g., cellulose derivatives, in silver diffusion transfer processes, and U.S. Pat. No. 4,009,031 discloses the use of stripping layers comprising a hydrophilic colloid and ammonia in color diffusion transfer processes employing polyvinylpyridine as the dyeable stratum, i.e., the image-receiving layer. As disclosed in these patents, the stripping layer is coated over the image-receiving layer and facilitates separation of the image-receiving component comprising the overcoated image-receiving layer from the layer of processing composition applied between the photosensitive and image-receiving elements. U.S. Pat. Nos. 2,983,606, 3,227,550 and 3,658,524 disclose color diffusion transfer film units wherein the photosensitive layer(s) and dyeable stratum are located in the same rather than in separate elements. As disclosed in the latter patents, a stripping layer is disposed between the photosensitive layer(s) and their associated image dye-providing material and an underlying dyeable stratum comprising the image-receiving layer. The processing composition is applied to the surface of the photosensitive layer(s) opposite the image-receiving layer, and subsequent to processing, the stripping layer aids in the separation of the dyeable stratum from the photosensitive layer(s) to reveal the final transfer image.

The present invention is concerned with novel stripping layers which are particularly useful in photographic products of the latter type where the stripping layer is disposed between a dyeable stratum and a photosensitive component, which dyeable stratum is separated from said photosensitive component subsequent to processing and transfer image formation.

SUMMARY OF THE INVENTION

It is, therefore, the primary object of the present invention to provide diffusion transfer photographic products containing a novel stripping layer.

It is another object of the present invention to provide diffusion transfer photographic processes employing said photographic products.

Other objects of this invention will in part be obvious and will in part appear hereinafter.

The invention accordingly comprises the several steps and the relation and order of one or more of such steps with respect to each of the others and the product possessing the features, properties and the relation of elements which are exemplified in the following detailed disclosure, and the scope of the application of which will be indicated in the claims.

For a fuller understanding of the nature and objects of the invention, reference should be had to the following detailed description taken in conjunction with the accompanying drawings.

DESCRIPTION OF THE PREFERRED EMBODIMENTS

Figure 1:
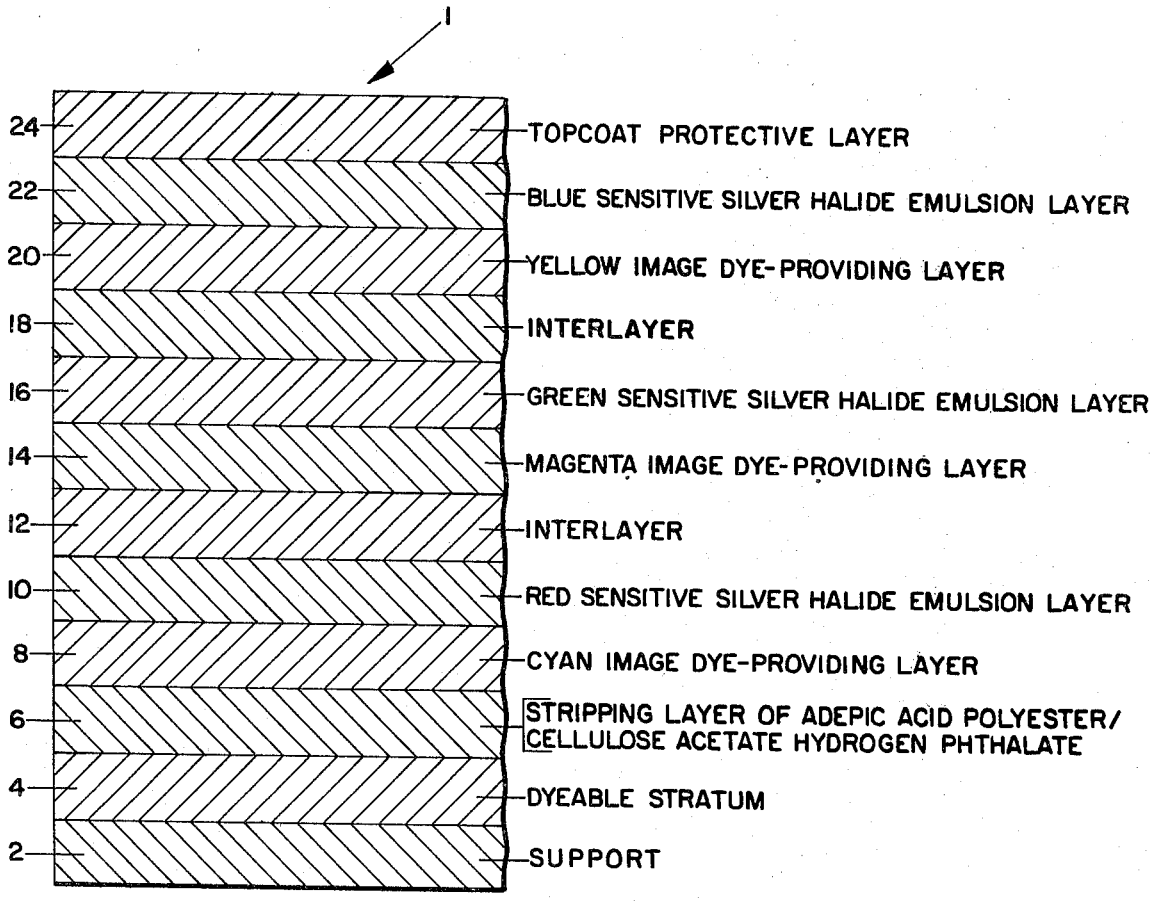
FIG. 1 is an enlarged, diagrammatic, fragmentary cross-sectional view of a photographic product illustrating one embodiment of this invention.

According to the present invention, it has been found that a stripping layer consisting of a mixture of cellulose acetate hydrogen phthalate and a straight chain saturated polyester of adipic acid facilitates separation of a dyeable stratum from a contiguous gelatin layer, such as a gelatino silver halide emulsion layer or a gelatin layer containing an image dye-providing material of an overlying photosensitive component, subsequent to formation of the dye transfer image in the dyeable stratum.

In such color diffusion transfer processes, color transfer images are obtained by (a) exposing a photographic film unit which comprises a laminate containing a plurality of layers including, in sequence, an image-receiving component comprising at least a dyeable stratum; a stripping layer of the present invention; and a photosensitive component comprising a gelatin layer contiguous with said stripping layer, said photosensitive component containing photosensitive silver halide dispersed in said gelatin layer or in a different layer and an image dye-providing material associated with said silver halide in the same or a different layer;

(b) developing said exposed film unit with a processing composition to form an imagewise distribution of a diffusible image dye-providing material; and (c) transferring said imagewise distribution, at least in part, by diffusion, to said dyeable stratum to provide a color transfer image thereon. The dyeable stratum together with any other layers comprising the image-receiving component are then separated from the photosensitive component with the aid of the stripping layer for viewing purposes.

The straight chain saturated polyester of adipic acid employed in the subject stripping layer is commercially available under the tradename "Resoflex-296". The ratio of this polyester to the cellulose acetate hydrogen phthalate may be adjusted to give the desired clean strip in a given film unit and usually varies between about 0.5 and 1.0 mgs of polyester per 1 mg of cellulose acetate hydrogen phthalate. The total coverage employed usually varies between about 60 and 120 mgs/ft$^2$. It will be appreciated by those skilled in the art that the ratio of polyester to cellulose acetate hydrogen phthalate and the total coverage of the stripping layer may be readily determined empirically to provide a clean strip in a given photographic film unit.

The subject stripping layers generally are formed by coating a solvent solution of the mixture of the polyester and cellulose acetate hydrogen phthalate on the surface of a dyeable stratum carried on a support and then evaporating the solvent to leave a stripping layer of the selected predetermined coverage. Usually, a solvent comprising a mixture of acetone and 2-methoxyethanol is employed, but other appropriate solvents also may be employed. The photosensitive component comprising a gelatin layer, for example, containing silver halide and/or dye image-providing material is then applied to the surface of the stripping layer opposite said dyeable stratum.

As mentioned previously, film units intended to provide multicolor images comprise two or more selectively sensitized silver halide emulsion layers each having associated therewith an appropriate image dye-providing material having spectral absorption characteristics substantially complementary to the light by which the associated silver halide is exposed. The most commonly employed negative components are of the tripack structure containing blue-, green- and red-sensitive silver halide emulsion layers each having associated therewith in the same or in a contiguous layer a yellow, a magenta or a cyan image dye-providing material, respectively. Interlayers or spacer layers may, if desired, be provided between the respective silver halide emulsion layers and associated image dye-providing materials or between other layers.

Image dye-providing materials which may be employed generally may be characterized as either (1) initially soluble or diffusible in the processing composition but are selectively rendered non-diffusible in an imagewise pattern as a function of development; or (2) initially insoluble or non-diffusible in the processing composition but which are selectively rendered diffusible or provide a diffusible product in an imagewise pattern as a function of development. These materials may be complete dyes or dye intermediates, e.g., color couplers.

Examples of initially soluble or diffusible materials and their application in color diffusion transfer processes are disclosed, for example, in U.S. Pat. Nos. 2,774,668; 2,968,554; 2,983,606; 3,087,817; 3,185,567; 3,230,082; 3,345,163; and 3,443,943. Examples of initially non-diffusible materials and their use in color diffusion transfer systems are disclosed in U.S. Pat. Nos. 3,185,567; 3,443,939; 3,443,940; 3,227,550; 3,227,551; 3,227,552; 3,227,554; 3,243,294; 3,445,228; 3,719,488; 3,719,489; and 4,076,529.

The image dye-providing materials are preferably selected for their ability to provide colors that are useful in carrying out subtractive color photography, that is, the previously mentioned cyan, magenta and yellow. When incorporated in a coating contiguous with the respective silver halide emulsion, the image dye-providing material may be applied by use of a coating solution containing the image dye-providing material in a concentration calculated to give the desired coverage of image dye-providing material per unit area in a film-forming natural or synthetic polymer, for example, gelatin, polyvinyl alcohol and the like, adapted to be permeated by the processing composition.

The image-receiving layer, i.e., the dyeable stratum may comprise one of the materials known in the art, such as polyvinyl alcohol, gelatin, etc., preferably containing a mordant for the transferred image dye(s). If the color of the transferred image dye(s) is affected by changes in pH, the pH of the image layer may be adjusted to provide the pH affording the desired color.

Where it is desired, an acid-reacting reagent may be employed in a layer of the film unit to lower the environmental pH following substantial dye transfer in order to increase the image stability, and where appropriate for the particular dye image-providing material, to adjust the pH from the first pH at which the image dyes are diffusible to a second (lower) pH at which they are not. The use of an acid-reacting reagent, such as, a polymeric acid layer in color diffusion transfer systems which employ an aqueous alkaline processing composition is well known and has been described, for example, in U.S. Pat. No. 3,362,819. The polymeric acids may be polymers which contain acid groups, e.g., carboxylic acid and sulfonic acid groups, which are capable of forming salts with alkali metals or with organic bases; or potentially acid-yielding groups such as anhydrides or lactones. Preferably, the acid polymer contains free carboxyl groups.

The polymeric acid layer may be positioned between the dyeable stratum and the support, or it may be in a layer adjacent the silver halide emulsion layer most distant from the image-receiving layer as described in U.S. Pat. No. 3,362,821. An inert interlayer or spacer layer may be disposed between the polymeric acid layer and the dyeable stratum in order to control or "time" the pH reduction so that it is not premature and interfere with the development process where image dye-providing materials, such as, dye developers are employed. Suitable spacer of "timing" layers for this purpose are described with particularity in U.S. Pat. Nos. 3,362,819; 3,419,389; 3,421,893; 3,455,686; and 3,575,701. Besides being disposed in the image-receiving and/or photosensitive components, the acid-reacting layer and any "timing" layer may be contained on the spreader sheet employed to facilitate application of the photographic processing composition.

As is now well known, the liquid processing composition used for effecting multicolor diffusion transfer processes comprises at least an aqueous solution of an alkaline material, for example, sodium hydroxide, potassium hydroxide and the like, and preferably possesses a pH in excess of 12 and preferably includes a viscosity-increasing compound constituting a film-forming material of the type which, when the composition is spread and dried, forms a relatively firm and relatively stable film. The preferred film-forming materials comprise high molecular weight polymers such as polymeric, water-soluble ethers which are inert to an alkaline solution, such as, a hydroxyethyl cellulose or sodium carboxymethyl cellulose. Other film-forming materials or thickening agents whose ability to increase viscosity is substantially unaffected if left in solution for a long period of time also are known to be useful. The film-forming material preferably is employed in quantities suitable to impart to the composition a viscosity in excess of 100 cps. at a temperature of approximately 24° C. and preferably in the order of 100,000 to 200,000 cps. at that temperature.

In addition to the above-named reagents, the processing composition may contain a developing agent and also may contain a silver halide solvent depending upon the image dye-providing material employed. For example, the image dye-providing materials disclosed in aforementioned U.S. Pat. No. 3,719,489 undergo cleavage in the presence of the imagewise distribution of silver ions and/or soluble silver complex formed in the unexposed and undeveloped areas of the silver halide emulsion to provide a corresponding imagewise distribution of a dye or dye intermediate. The silver halide developing agent may be any of those commonly employed, such as dihydroxybenzenes, e.g., hydroquinone; diamino benzenes, e.g., paraphenylenediamine; aminophenols, e.g., methyl-p-aminophenol; ascorbic acid and its derivatives and other enediols, e.g., tetramethyl reductic acid. The silver halide solvent also may be any of those commonly employed, such as, thiosulfates, e.g., sodium or potassium thiosulfates; cyclic imides, e.g., uracil, thioether-substituted uracils and pseudo-uracils; and $\beta$-disulfones, e.g., 1,1-bis-sulfonyl alkanes and 1,3-disulfonylcycloalkanes. As further discloses therein, rather than being in the processing composition initially, the silver halide developing agent and/or the silver halide solvent may be present initially in the film unit, and then dissolved into an aqueous alkaline solution applied to the film unit subsequent to exposure. The use of an auxiliary silver halide developing agent, e.g., a 3-pyrazolidone, with dye developers, i.e., image dye-providing materials which contain, in the same molecule, both the chromophoric system of a dye and also a silver halide developing function is disclosed in aforementioned U.S. Pat. No. 2,983,606. The auxiliary developing agent may be contained in the processing composition and/or in one or more layers of the film unit.

It will be appreciated that the processing composition may be applied to the exposed photosensitive element by coating, spraying, dipping, etc., or the processing composition may be confined initially in a rupturable container such as disclosed in U.S. Pat. No. 2,543,181. As is well known in the art, such a container is positioned in the film unit so as to be capable upon rupture of releasing its contents between two superposed layers, for example, the outermost layer of the photosensitive component and a superposed spreader sheet. In processing film units utilizing such containers, the film unit is advanced relative to and between a pair of pressure-applying members, for example, a pair of rollers which apply compressive pressure to the rupturable container to eject and distribute its liquid contents in a substantially uniform layer of predetermined thickness.

The invention will be more readily understood by reference to the accompanying drawings.

FIG. 1 illustrates one embodiment of this invention wherein a support 2 carries, in order, a dyeable stratum 4, a stripping layer of adipic acid polyester/cellulose acetate hydrogen phthalate 6, a layer 8 of cyan image dye-providing material dispersed in gelatin, a layer 10 of a red-sensitive silver halide emulsion, an interlayer 12, a layer 14 of a magenta image dye-providing material, a layer 16 of a green-sensitive silver halide emulsion, an interlayer 18, a layer 20 of a yellow image dye-providing material, a layer 22 of a blue-sensitive silver halide emulsion, and a topcoat protective layer 24, usually a gelatin layer containing a gelatin hardener, such as, succindialdehyde.

The support 2 may be transparent or opaque, depending upon whether transparencies or reflection prints are desired, and it may comprise any of the support materials heretofore employed. Such materials include, for example, cellulose acetate, cellulose nitrate, polyvinyl acetal, polystyrene, polyethylene terephthalate, polyethylene, paper, glass, etc.

Figure 2:
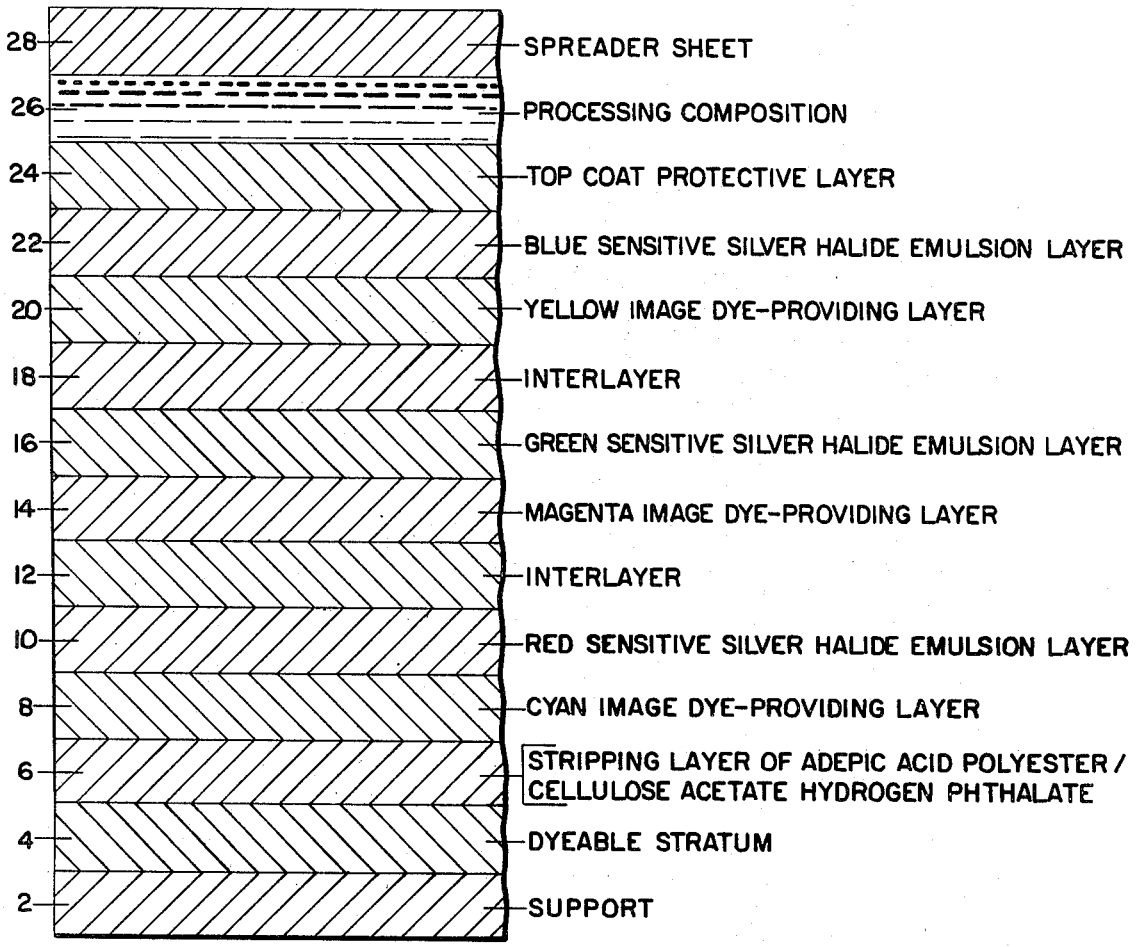
FIG. 2 is a similar view showing the previously exposed photographic product of FIG. 1 during processing thereof.

FIG. 2 illustrates one method of developing the previously exposed element of FIG. 1 to form a color image by spreading a processing composition 26 in a substantially uniform layer between the exposed element and a superposed spreader sheet 28 to facilitate this uniform spreading. The spreader sheet may be made of any sheet material such as those previously mentioned as useful support materials. Spreader sheet 28 may carry a coating, e.g., of a hydrophilic material, to assure that it has a greater affinity or adhesiveness toward the processing composition than does the stripping layer 6 toward the dyeable stratum.

Figure 3:
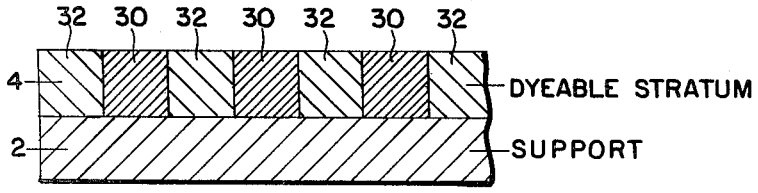
FIG. 3 illustrates a color image obtained after such processing.

As illustrated in FIG. 2, the film unit 1, subsequent to exposure, is processed by applying a layer of processing composition 26 with the aid of the spreader sheet 28. The processing composition permeates the emulsion layers 10, 16 and 22 to initiate development of the latent images contained in the respective emulsions. As a function of this development, an imagewise distribution is formed of diffusible cyan, magenta and yellow image dye-providing materials which corresponds to the unexposed and partially exposed areas of their associated silver halide emulsion layers 10, 16 and 22, respectively. The imagewise distributions of diffusible cyan, magenta and yellow image dye-providing materials are then transferred, by diffusion, to dyeable stratum 4 to impart a multicolor dye transfer image thereto. Following transfer image formation, the dyeable stratum is separated from the stripping layer to reveal the image which, as shown in FIG. 3, comprises dyeable stratum 4 on support 2, the image being shown as having dye-containing areas 30 and non-image or highlight areas 32. In a preferred embodiment, support 2 is transparent and the image shown in FIG. 3 is a color transparency.

By way of illustration, a dyeable stratum comprising a mixture of about 3 parts of (a) a mixture of about 2 parts of polyvinyl alcohol and 1 part of poly-4-vinylpyridine and (b) 1 part of a graft copolymer of 4-vinylpyridine and vinylbenzyltrimethyl ammonium chloride or hydroxyethyl cellulose (mole ratio 2.2/2.2/1) was coated at a coverage of about 300 mgs./ft$^2$ on a transparent subcoated polyethylene terephthalate support. Over this was applied a stripping layer of the present invention by coating a solution of cellulose acetate hydrogen phthalate (CAHP) and adipic acid polyester (Resoflex-296) in acetone/2-methoxyethanol to provide a layer containing 35 mgs/ft$^2$ CAHP and 25 mgs/ft$^2$ polyester. Over the stripping layer was coated a photosensitive component comprising the following layers.

(a) 100 mgs/ft$^2$ of gelatin containing 300 mgs/ft$^2$ of a cyan image dye-providing compound, (b) a gelatin silver iodobromide emulsion coated at a coverage of 75 mgs/ft$^2$ of silver and 58 mgs/ft$^2$ of gelatin and containing 30 mgs/ft$^2$ of 4'-methylphenylhydroquinone, and (c) 30 mgs/ft$^2$ of gelatin containing 2.5 mgs/ft$^2$ of succindialdehyde.

The cyan image dye-providing compound employed had the formula

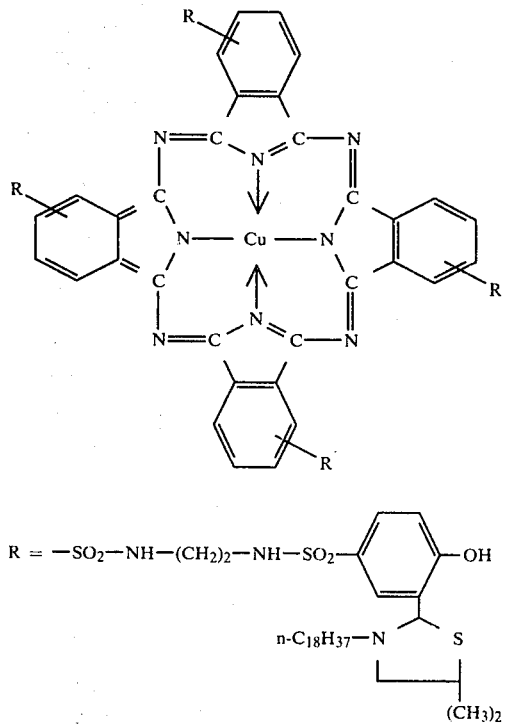

This film unit was exposed to a stepwedge and then processed in the dark by spreading an aqueous processing composition approximately 0.0044 inch thick on top of the photosensitive component with the aid of a transparent polyethylene terephthalate spreader sheet. The processing composition comprised an aqueous solution containing, by weight, 7% potassium hydroxide, 2.0% carboxymethyl hydroxyethyl cellulose, 1.5% 6-methylthiomethyluracil and 0.009% 2-thiouracil.

After an imbibition time of about 10 minutes in the dark, the image-receiving layer, i.e., dyeable stratum, was separated from the spreader sheet and adhered photosensitive component to reveal the transfer image. Inspection of the image-receiving layer showed a moderately clean strip. When a stripping layer containing 70 mgs/ft$^2$ CAHP and 50 mgs/ft$^2$ Resoflex-296 polyester was employed, inspection of the image-receiving layer showed a clean, complete strip.

As a comparison, a film unit was prepared, exposed and processed as described above except that the stripping layer was composed solely of cellulose acetate hydrogen phthalate coated at a coverage of 70 mgs/ft$^2$. After stripping, inspection of the image-carrying layer showed cracking and an incomplete strip.

Additional film units were prepared and processed in substantially the same manner as described above using different image-receiving layers, i.e., different dyeable strata but using identical stripping layers each of which contained 70 mgs/ft$^2$ CAHP and 50 mgs/ft$^2$ of Resoflex-296 polyester. The dyeable strata employed were as follows:

(1) A graft copolymer of 4-vinylpyridine and vinylbenzyltrimethyl ammonium chloride on hydroxyethyl cellulose (mole ratio 2.2/2.2/1).

(2) A graft copolymer of 4-vinylpyridine and vinylbenzyltrimethyl ammonium chloride on hydroxyethyl cellulose (mole ratio 4.4/6.0/4.4).

(3) A mixture of 1 part poly-4-vinylpyridine and 2 parts of polyvinyl alcohol.

(4) A mixture of about 3 parts poly-4-vinylpyridine and 1 part of a graft copolymer of 4-vinylpyridine and vinylbenzyltrimethyl ammonium chloride on hydroxyethyl cellulose (mole ratio 2.2/2.2/1). With all of these dyeable strata, the stripping layer gave a clean, complete strip.

It will be appreciated that the order of the layers of the photosensitive component may be varied according to the requirements of a given photographic system and that dyeable strata other than those specifically mentioned may be employed. Indeed, the subject stripping layers are broadly useful in film units where it is desired to employ a stripping or release layer between a dyeable stratum and a contiguous gelatin-containing layer of a photosensitive component.

Since certain changes may be made in the above subject matter without departing from the scope of the invention herein involved, it is intended that all matter contained in the above description shall be interpreted as illustrative and not in a limiting sense.

What is claimed is:

1. A photograhic product which comprises a laminate which contains a plurality of layers including, in sequence, a support; an image-receiving component comprising a dyeable stratum; a stripping layer consisting of a mixture of cellulose acetate hydrogen phthalate and straight chain saturated polyester of adipic acid; and a photosensitive component comprising a gelatin layer contiguous with said stripping layer, said photosensitive component containing photosensitive silver halide dispersed in said gelatin layer or in a separate layer and an image dye-providing material associated with said silver halide in the same or a different layer.

2. A photographic product as defined in claim 1 wherein said photosensitive component comprises, in sequence, a layer of cyan image dye-providing material dispersed in gelatin contiguous with said stripping layer; a red sensitive silver halide emulsion layer; a layer of magenta image dye-providing material dispersed in gelatin; a green sensitive silver halide emulsion layer; a layer of yellow image dye-providing material dispersed in gelatin; and a blue sensitive silver halide emulsion layer.

3. A photographic product as defined in claim 1 which additionally includes (a) a spreader sheet adapted to be superposed during processing in a position substantially coextensive with the surface of said laminate opposite to the support for said laminate, and (b) a rupturable container retaining a processing composition adapted to discharge its contents during processing between the superposed spreader sheet and the surface of said laminate opposite said support.

4. A photographic product as defined in claim 3 which additionally includes a polymeric acid layer.

5. A photographic product as defined in claim 1 wherin the weight ratio of said polyester to said cellulose acetate hydrogen phthalate is about 0.5–1:1.

6. A photographic process for forming a color diffusion transfer image which comprises the steps of (1) exposing a photosensitive film unit comprising a laminate which contains a plurality of layers including, in sequence, a support; an image-receiving component comprising a dyeable stratum; a stripping layer consisting of a mixture of cellulose acetate hydrogen phthalate and a straight chain saturated polyester of adipic acid; and a photosensitive component comprising a gelatin layer contiguous with said stripping layer, said photosensitive component containing photosensitive silver halide dispersed in said gelatin layer or in a separate layer and an image dye-providing material associated with said silver halide in the same or a different layer;

(2) developing said photoexposed film unit by applying an aqueous alkaline processing composition to the surface of said laminate opposite the support for said laminate;

(3) forming as a result of said development, an imagewise distribution of diffusible image dye-providing material;

(4) transferring, by diffusion, at least a portion of said imagewise distribution of diffusible image dye-providing material to the dyeable stratum of said image-receiving component to provide a transfer image thereon; and (5) subsequent to transfer image formation, separating said image-receiving component from said laminate.

7. A photographic process as defined in claim 6 wherein said photosensitive component comprises, in sequence, a layer of cyan image dye-providing material dispersed in gelatin contiguous with said stripping layer; a red sensitive silver halide emulsion layer; a layer of magenta image dye-providing material dispersed in gelatin; a green sensitive silver halide emulsion layer; a layer of yellow image dye-providing material dispersed in gelatin; and a blue sensitive silver halide emulsion layer.

8. A photographic process for forming diffusion transfer images in color which comprises the steps of (1) exposing a photosensitive film unit comprising a laminate which contains a plurality of layers including, in sequence, a support; an image-receiving component comprising a dyeable stratum; a stripping layer consisting of a mixture of cellulose acetate hydrogen phthalate and a straight chain saturated polyester of adipic acid; a photosensitive component comprising a gelatin layer contiguous with said stripping layer, said photosensitive component containing photosensitive silver halide dispersed in said gelatin layer or in a separate layer and an image dye-providing material associated with said silver halide in the same or in a different layer; a spreader sheet adapted to be superposed coextensive with the surface of said laminate opposite said support upon passage of said film unit through a pair of pressure-applying members; and a rupturable container retaining a processing composition adapted to discharge its contents between said spreader sheet and said laminate upon passage of said film unit through said pair of pressure-applying members;

(2) passing said film unit through said pair of pressure-applying members whereby said spreader sheet is superposed coextensive with said laminate and the processing composition is discharged from said rupturable container between said spreader sheet and said laminate;

(3) effecting thereby development of said silver halide layer;

(4) forming as a result of said development, an imagewise distribution of diffusible image dye-providing material;

(5) transferring, by diffusion, at least a portion of said imagewise distribution of diffusible image dye-providing material to the dyeable stratum of said image-receiving component to provide a transfer image thereon; and (6) subsequent to transfer image formation, separating said image-receiving component from said laminate.

9. A photographic process as defined in claim 8 wherein said image-receiving component includes a polymeric acid layer between said support and said dyeable stratum.

10. A photographic process as defined in claim 8 wherein said photosensitive component comprises, in sequence, a layer of cyan image dye-providing material dispersed in gelatin contiguous with said stripping layer; a red sensitive silver halide emulsion layer; a layer of magenta image dye-providing material dispersed in gelatin; a green sensitive silver halide emulsion layer; a layer of yellow image dye-providing material dispersed in gelatin; and a blue sensitive silver halide emulsion layer.

11. A photographic process as defined in claim 8 wherein the weight ratio of said polyester to said cellulose acetate hydrogen phthalate in said stripping layer is 0.5–1:1.

* * * * *